US007328898B2

(12) United States Patent
Yasui et al.

(10) Patent No.: US 7,328,898 B2
(45) Date of Patent: Feb. 12, 2008

(54) IMAGE FORMING APPARATUS INCLUDING TIMING DETERMINATION UNIT, AND CORRESPONDING SHEET FEEDING METHOD

(75) Inventors: Kazumasa Yasui, Arakawa-ku (JP); Masaya Arakawa, Hiratsuka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 7 days.

(21) Appl. No.: 11/261,788

(22) Filed: Oct. 31, 2005

(65) Prior Publication Data

US 2006/0202409 A1 Sep. 14, 2006

(30) Foreign Application Priority Data

Mar. 10, 2005 (JP) ..... 2005-066886

(51) Int. Cl.
*B65H 5/34* (2006.01)

(52) U.S. Cl. ..... 271/270; 271/264; 271/265.01; 399/396; 399/395

(58) Field of Classification Search ..... 271/264, 271/270, 265.01; 399/396, 395, 370
See application file for complete search history.

(56) References Cited

U.S. PATENT DOCUMENTS 3,957,366 A 5/1976 Taylor et al.
4,300,756 A 11/1981 Danchak et al.
4,892,301 A * 1/1990 Barrois et al. ..... 271/227
4,986,528 A 1/1991 Watarai et al.
5,423,527 A * 6/1995 Tranquilla ..... 271/10.02
5,482,265 A * 1/1996 Nakazato et al. ..... 271/242
5,484,141 A 1/1996 Yamashita et al.
5,575,466 A * 11/1996 Tranquilla ..... 271/10.03
5,645,273 A 7/1997 Nakagawa et al.
5,678,488 A 10/1997 Yamaguchi et al.
6,135,446 A 10/2000 Thiemann et al.

(Continued)

FOREIGN PATENT DOCUMENTS

JP 07-223756 A 8/1995

(Continued)

OTHER PUBLICATIONS

U.S. Appl. No. 11/176,380, filed Jul. 8, 2005, Yasui.

(Continued)

*Primary Examiner*—Patrick Mackey
*Assistant Examiner*—Gerald W McClain
(74) *Attorney, Agent, or Firm*—Foley & Lardner LLP

(57) ABSTRACT

An image forming apparatus including a drive unit that drives a drive control unit that supplies a first drive current to the drive unit so as to acceleratingly drive an intermediate feeding roller, and supplies a current that is smaller than the first drive current so as to uniformly drive the intermediate feeding roller, and a timing determination unit that determines the timing of supplying a current smaller than the first drive current to uniformly drive the intermediate feeding roller after supplying the first drive current to the drive unit to acceleratingly drive the intermediate feeding roller, wherein in case the timing determination unit determines that the timing to acceleratingly drive the intermediate feeding roller comes to an end, the drive control unit supplies the first drive current to the drive unit for a time period prolonged by a predetermined time period.

13 Claims, 8 Drawing Sheets

U.S. PATENT DOCUMENTS

| | | | | |
|---|---|---|---|---|
| 6,550,764 | B2 * | 4/2003 | Wilson et al. | 271/270 |
| 6,626,428 | B2 | 9/2003 | Soga et al. | |
| 6,641,134 | B1 | 11/2003 | Dobbertin et al. | |
| 6,644,660 | B2 * | 11/2003 | Sussmeier et al. | 271/270 |
| 6,726,199 | B2 * | 4/2004 | Ina et al. | 271/65 |
| 6,931,230 | B2 * | 8/2005 | Yasui | 399/396 |
| 7,063,472 | B2 | 6/2006 | Matsuda et al. | |
| 2002/0039119 | A1 * | 4/2002 | Igarashi | 347/16 |
| 2003/0044217 | A1 | 3/2003 | Matsuda et al. | |
| 2003/0062671 | A1 | 4/2003 | Yasui et al. | |
| 2004/0080098 | A1 | 4/2004 | Yamashita et al. | |
| 2005/0062211 | A1 * | 3/2005 | Botschek et al. | 271/2 |
| 2005/0074267 | A1 | 4/2005 | Demchock et al. | |
| 2007/0114717 | A1 | 5/2007 | Taniyama | |

FOREIGN PATENT DOCUMENTS

| | | | |
|---|---|---|---|
| JP | 10-120216 | A | 5/1998 |
| JP | 10-167511 | A | 6/1998 |
| JP | 11-020992 | A | 1/1999 |
| JP | 11-124255 | A | 5/1999 |
| JP | 11-184191 | A | 7/1999 |
| JP | 2001-130811 | A | 5/2001 |
| JP | 2002-37481 | A | 2/2002 |
| JP | 2002-154682 | A | 5/2002 |
| JP | 2002-234629 | A | 8/2002 |
| JP | 2003-306250 | A | 10/2003 |
| JP | 2004-018195 | A | 1/2004 |
| JP | 2004-302182 | A | 10/2004 |

OTHER PUBLICATIONS

U.S. Appl. No. 11/232,944, filed Sep. 23, 2005, K. Yasui et al.
U.S. Appl. No. 11/260,271, filed Oct. 28, 2005, K. Yasui et al.
U.S. Appl. No. 11/260,315, filed Oct. 28, 2005, K. Yasui et al.
U.S. Appl. No. 11/260,387, filed Oct. 28, 2005, K. Yasui et al.
U.S. Appl. No. 11/260,459, filed Oct. 28, 2005, K. Yasui et al.
K. Yasui et al., U.S. PTO Office Action, U.S. Appl. No. 11/260,315, filed Aug. 27, 2007, 8 pages.
K. Yasui et al., U.S. PTO Office Action, U.S. Appl. No. 11/260,387, filed Jul. 18, 2007, 11 pages.

* cited by examiner

IMAGE FORMING APPARATUS INCLUDING TIMING DETERMINATION UNIT, AND CORRESPONDING SHEET FEEDING METHOD

BACKGROUND OF THE INVENTION

1. Field of the Invention

The present invention relates to an image forming apparatus and a sheet feeding method.

2. Description of the Related Art

Conventionally, in an image forming apparatus, correcting oblique-passing and adjusting timing (or so-called aligning) for sheets being fed are carried out by a regist roller or the like (see, for example, Jpn. Pat. Appln. Laid-Open Publication No. 10-167511). FIG. 7 shows a cross-sectional view indicative of the entire configuration of a conventional image forming apparatus.

In the image forming apparatus shown in FIG. 7, the following processing is performed. Firstly, sheets stocked in cassettes 31, 32, 33, and 34 are picked up by pickup rollers 31*b*, 32*b*, 33*b*, and 34*b*. Then, thus picked up sheets are separated to respective papers one by one by paper feeding rollers 31*a*, 32*a*, 33*a*, and 34*a* and separation rollers 31*c*, 32*c*, 33*c*, and 34*c* to be supplied to a sheet feeding path 35. Sheets fed to the sheet feeding path 35 are carried forward right before an intermediate feeding roller 38 by feeding rollers 36*a* to 36*d*. The intermediate feeding roller 38 is provided with a function of carrying forward sheets fed by an ADU 5, to be described later, or sheets fed on the sheet feeding path 35 to a regist roller 37 for correcting oblique-passing and adjusting timing for sheets.

After undergoing oblique-passing correction and timing adjustment, toner images formed on the photosensitive surface of a photosensitive drum 20 are transcribed to sheets carried forward to the regist roller 37 through the intermediate feeding roller 38. Toner images transcribed to sheets are fixed on the sheets by a fixing unit 24. Sheets having images fixed thereon are directly discharged to the outside of the image forming apparatus in case of one-side printing, and are carried forward to a reverse feeding path 28 in case of duplex printing or in case sheets that have undergone one-side printing are discharged after being reversed.

In case of duplex printing, sheets directed to the reverse feeding path 28 are made to switchback to be fed by a reverse rollers 29 and 30 to be sent to an ADU 5. Sheets sent to the ADU 5 are fed by feeding rollers 5*a* to 5*d*, and are directed to the intermediate feeding roller 38 again. Then, image forming processing by the photosensitive drum 20 and fixing unit 24 are carried out for the other sides of sheets fed through the ADU 5, realizing duplex printing for sheets.

FIG. 8 shows a view for explaining the sheet feeding right before the regist roller, which is an enlarged view of part enclosed by a dotted line in FIG. 7.

As shown in FIG. 8, in the image forming apparatus of above-described configuration, so as to correct oblique-passing and adjusting timing for sheets carried forward to the regist roller 37, the rotary drive of the regist roller 37 is stopped. Then, a sheet that is applied to a nip portion of the regist roller 37 is further pushed to bring about a deflection A by the intermediate feeding roller 38. After the deflection A is sufficiently raised, sheet feeding operation by the intermediate feeding roller 38 and the feeding roller 36*a* etc., located at the upstream of the intermediate feeding roller 38 is stopped to carry out aligning.

In case the feeding roller 36*a* etc., are of configuration in which motive power is transmitted through a clutch, there may be raised a delay in stopping feeding rollers due to a slip of the clutch and so on. This delay in the stop operation becomes the cause of occurrence of a deflection B right before the intermediate feeding roller 38. In general, the deflection A is larger than the deflection B.

In the conventional image forming apparatus of above-described configuration, when resuming the operation of feeding a sheet by the regist roller 37 after aligning the sheet, since the intermediate feeding roller 38 and the regist roller 37 are operated in synchronization with each other, sheet feeding speed of the intermediate feeding roller 38 and that of the regist roller 37 are equal to each other. So, the deflection B which is smaller than the deflection A raised at the time of aligning is necessarily eliminated faster than the deflection A. That is, the intermediate feeding roller 38 has to feed a sheet independently until the deflection A between the regist roller 37 and the intermediate feeding roller 38 is eliminated.

However, in case of aligning a sheet whose size is large in the sheet feeding direction (A3 size etc.), or in case a sheet is fed to the sheet feeding path 35 from a position near the intermediate feeding roller 38 (for example, in case a sheet is supplied from the cassettes 31, 32 of the upper stages), when the intermediate feeding roller 38 resumes the sheet feeding, the posterior edge of the sheet is pinched by the paper feeding rollers and the separation rollers whose retention torque is large, and there may be raised a case in which the intermediate feeding roller 38 (driven by a pulse motor and so on) whose torque is not large cannot feeding the sheet independently since the feeding load is too large (refer to a sheet P1 shown in FIG. 8). Such a problem is also raised in case a sheet is pinched by the feeding rollers 5*c* or 5*d* when the sheet is supplied to the sheet feeding path 35 from the ADU 5, or in case a sheet is pinched by many feeding rollers on the sheet feeding path 35 (refer to a sheet P2 indicated by a dotted line shown in FIG. 8). The above-described overload to the intermediate feeding roller 38 becomes the cause of failure such as step-out of an intermediate feeding motor for driving the intermediate feeding roller 38 and sheet jam.

The problem of lack of torque can be solved by driving the intermediate feeding roller 38 using a clutch to increase the torque, or by using a pulse motor of large torque, which undesirably prevents a reduction of cost and miniaturization of the device.

SUMMARY OF THE INVENTION

It is therefore an object of the present invention to overcome the above-mentioned drawbacks by providing an image forming apparatus, a sheet feeding method, and a sheet feeding program that can suppress the occurrence of failure in feeding sheets without preventing a reduction of cost and miniaturization of the device.

To overcome the above-mentioned drawbacks an image forming apparatus according to the present invention, includes a drive unit that drives rollers for feeding sheets to be fed, a drive control unit that supplies a first drive current to the drive unit so as to acceleratingly drive the rollers, and supplies a current that is smaller than the first drive current so as to uniformly drive the rollers, and a timing determination unit that determines the timing of supplying a current smaller than the first drive current to uniformly drive the rollers after supplying the first drive current to the drive unit to acceleratingly drive the rollers, wherein in case the timing determination unit determines that the timing to acceleratingly drive the rollers comes to an end, the drive control unit supplies the first drive current to the drive unit for a time period prolonged by a predetermined time period.

Further, an image forming apparatus according to the present invention, includes a drive unit that drives an intermediate feeding roller for feeding sheets to a regist roller for correcting oblique-passing of sheets being fed, a drive control unit that supplies a first drive current to the drive unit so as to acceleratingly drive the intermediate feeding roller, and supplies a current that is smaller than the first drive current so as to uniformly drive the intermediate feeding roller, and a timing determination unit that determines the timing of supplying a current smaller than the first drive current to uniformly drive the intermediate feeding roller after supplying the first drive current to the drive unit to acceleratingly drive the intermediate feeding roller, wherein in case the timing determination unit determines that the timing to acceleratingly drive the intermediate feeding roller comes to an end, the drive control unit supplies the first drive current to the drive unit for a time period prolonged by a predetermined time period.

Furthermore, according to the present invention, there is also provided a sheet feeding method, including: a drive control step that supplies a first drive current to a drive unit that drives an intermediate feeding roller for feeding sheets to a regist roller for correcting oblique-passing of sheets being fed so as to acceleratingly drive the intermediate feeding roller, and supplies a current that is smaller than the first drive current so as to uniformly drive the intermediate feeding roller, and a timing determination step that determines the timing of supplying a current smaller than the first drive current to uniformly drive the intermediate feeding roller after supplying the first drive current to the drive unit to acceleratingly drive the intermediate feeding roller, wherein in case the timing determination step determines that the timing to acceleratingly drive the intermediate feeding roller comes to an end, the drive control step supplies the first drive current to the drive unit for a time period prolonged by a predetermined time period.

DETAILED DESCRIPTION OF THE PREFERRED EMBODIMENTS

The present invention will further be described below with reference to the accompanying drawings.

Figure 1:
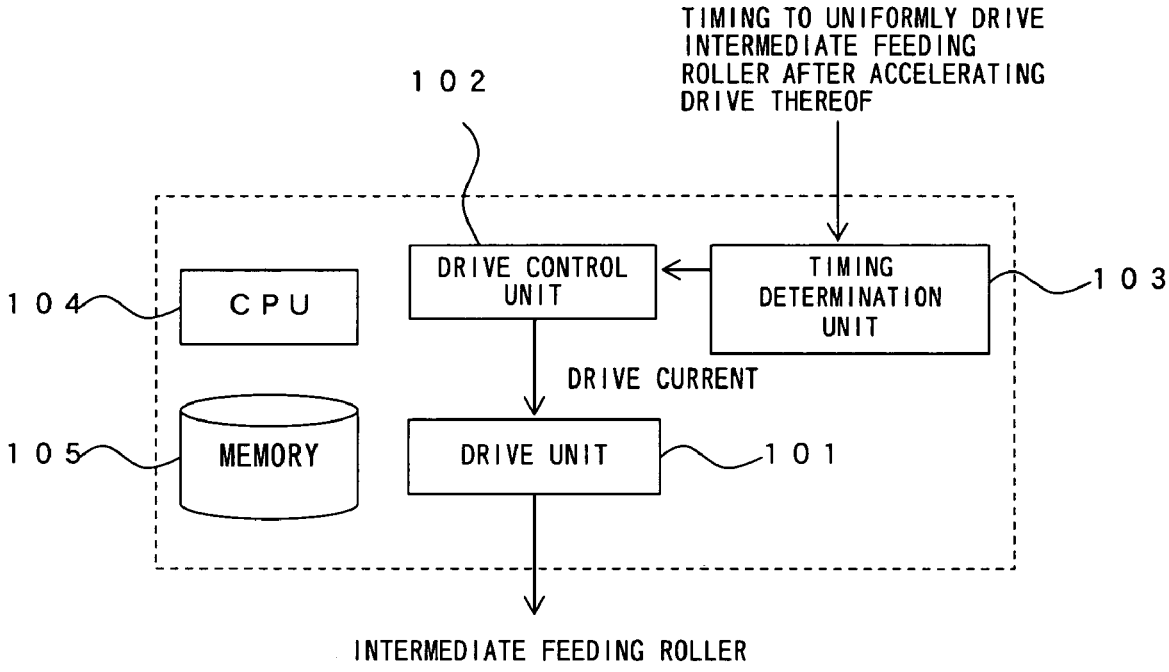
FIG. 1 shows a block diagram for explaining an image forming apparatus according to the present embodiment.

FIG. 1 shows a block diagram for explaining the image forming apparatus according to the present embodiment. The basic configuration of the sheet feeding route etc., of the image forming apparatus according to the present embodiment is similar to that of the conventional image forming apparatus shown in FIG. 7 and FIG. 8. Therefore, parts or components similar to those shown in FIG. 7 and FIG. 8 are indicated with the same reference numerals, and detailed explanation thereof will be omitted.

Figure 7:
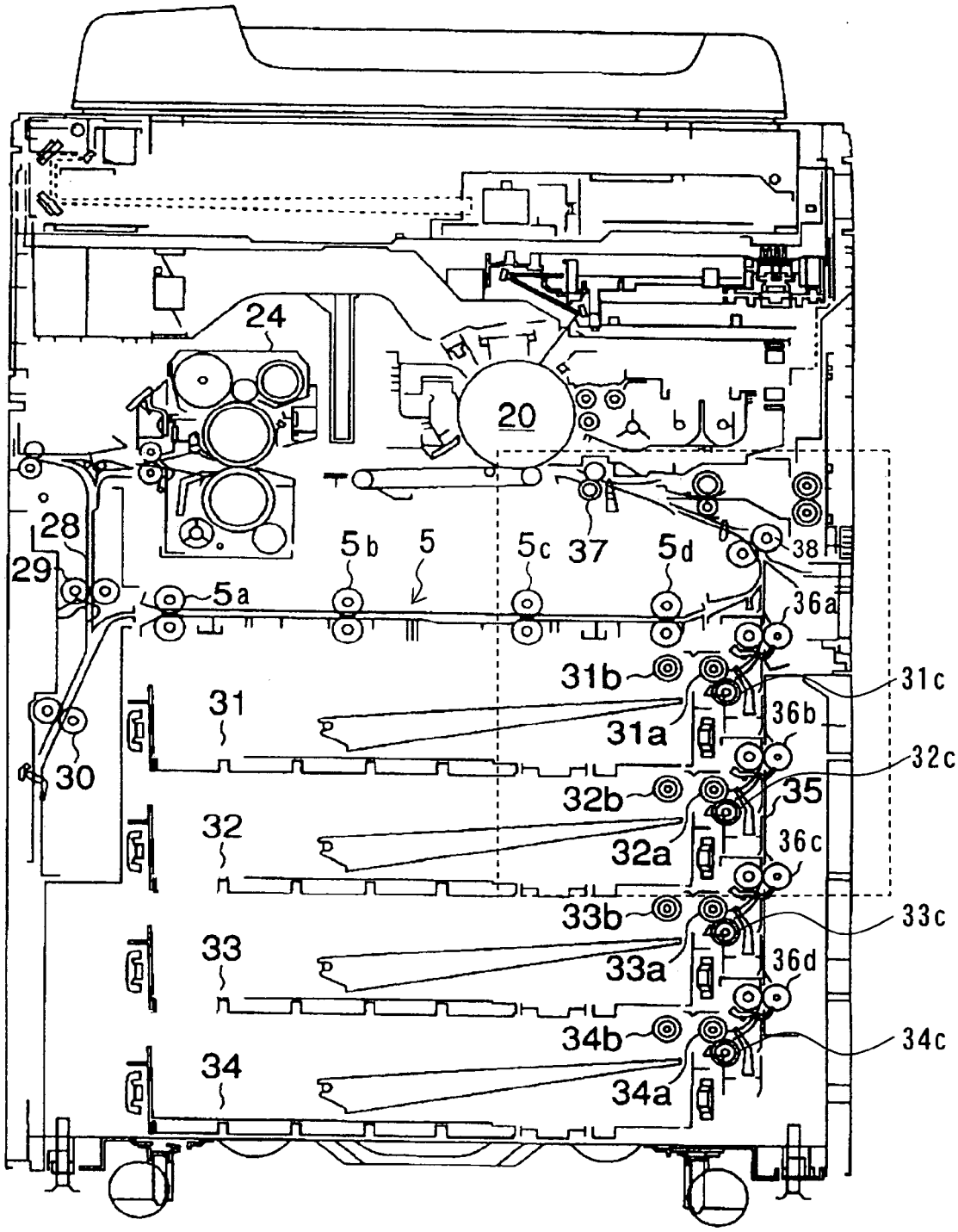
FIG. 7 shows a cross-sectional view indicative of the entire configuration of a conventional image forming apparatus.
Figure 8:
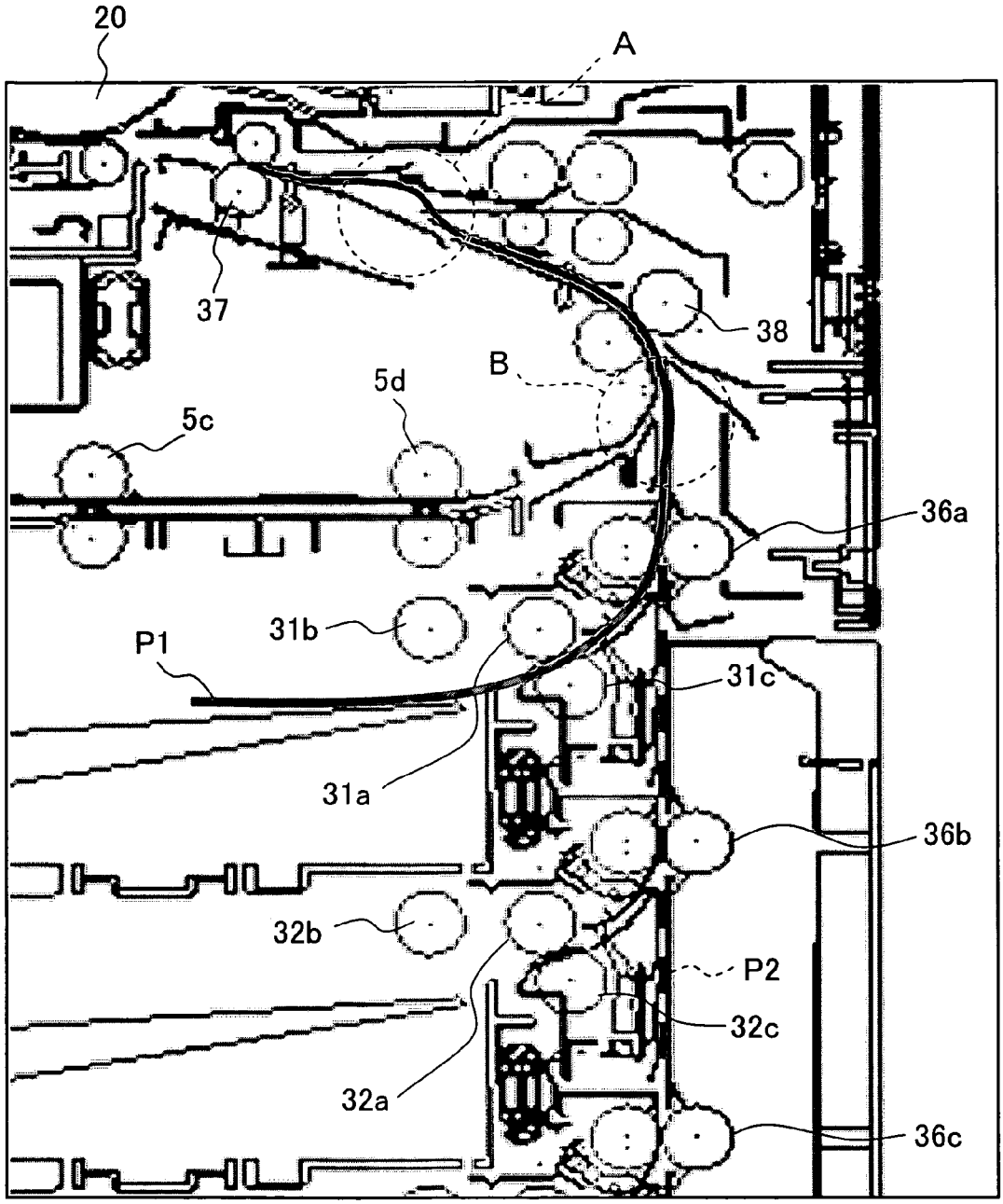
FIG. 8 shows a view for explaining the sheet feeding right before a regist roller, which is an enlarged view of part enclosed by a dotted line in FIG. 7.

The image forming apparatus according to the present embodiment includes, in addition to the configuration shown in FIG. 7, a drive unit 101, a drive control unit 102, a timing determination unit 103, a CPU 104, and a MEMORY 105.

The drive unit 101 corresponds to an intermediate feeding motor, and is provided with a function of driving an intermediate feeding roller 38 for feeding sheets to a regist roller 37 for correcting oblique-passing of sheets being fed. Hereinafter in the present embodiment, it is considered that the drive unit 101 is a pulse motor.

The drive control unit 102 is provided with a function of supplying a first drive current to the drive unit 101 so as to acceleratingly drive the intermediate feeding roller 38, and supplying a current that is smaller than the first drive current to the drive unit 101 so as to uniformly drive the intermediate feeding roller 38.

The timing determination unit 103 is provided with a function of determining the timing of supplying a current smaller than the first drive current to the drive unit 101 to uniformly drive the intermediate feeding roller 38 after supplying the first drive current to the drive unit 101 to acceleratingly drive the intermediate feeding roller 38.

The CPU 104 is provided with a function of carrying out various processing in the image forming apparatus, and is also provided with a function of realizing various functions by executing programs stored in the MEMORY 105. The MEMORY 105 may be a ROM, a RAM, etc., and is provided with a function of storing various information and programs to be utilized in the image forming apparatus.

Furthermore, in case the timing determination unit 103 determines that the timing to acceleratingly drive the intermediate feeding roller 38 comes to an end, the drive control unit 102 supplies the first drive current to the drive unit 101 for a time period prolonged by a predetermined time period.

Figure 2:
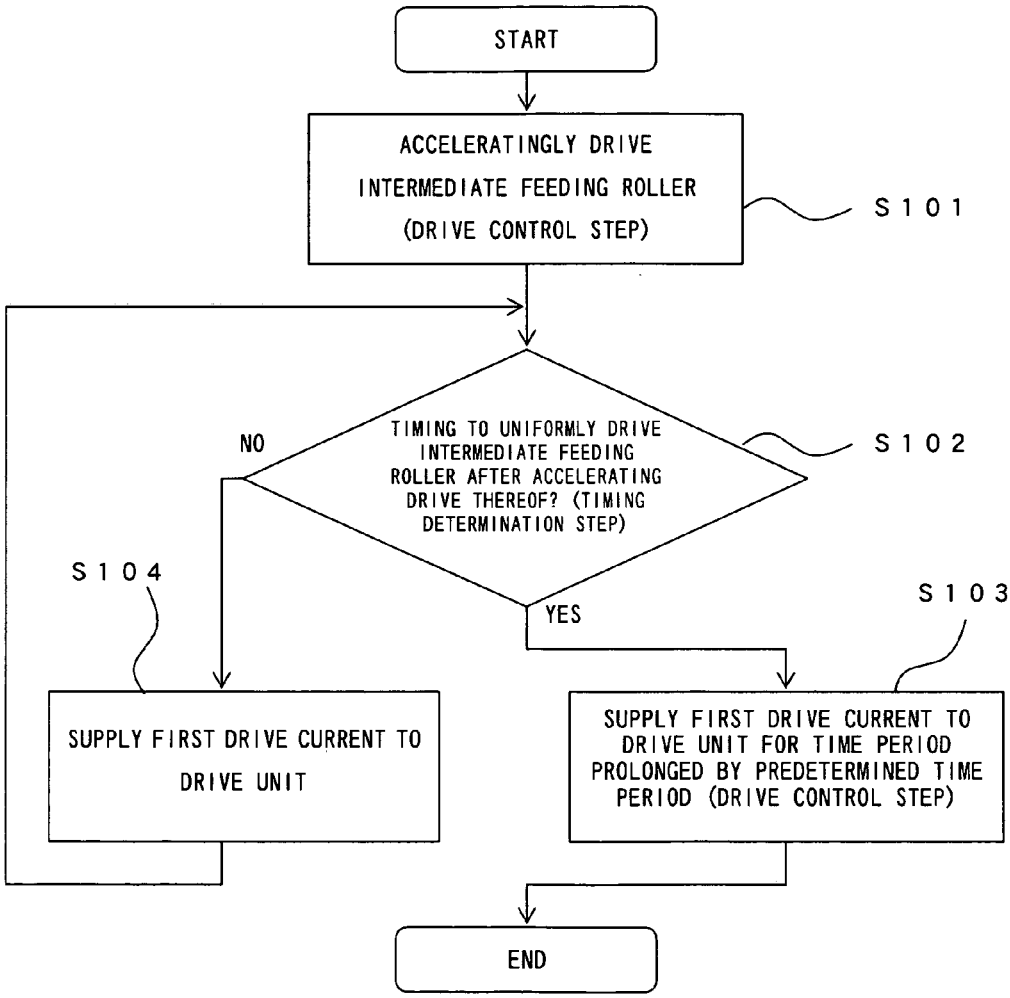
FIG. 2 shows a flowchart indicative of the entire flow of processing in a sheet feeding method according to the present embodiment.

Next, the sheet feeding method according to the present embodiment will be explained. FIG. 2 shows a flow chart indicative of the entire flow of processing in the sheet feeding method according to the present embodiment.

The drive control unit 102 supplies the first drive current to the drive unit 101 for driving the intermediate feeding roller 38 that feeds sheets to the regist roller 37 for correcting oblique-passing of sheets being fed so as to acceleratingly drive the intermediate feeding roller 38 (drive control step) (S101).

The timing determination unit 103 determines the timing of supplying a current smaller than the first drive current to the drive unit 101 to uniformly drive the intermediate feeding roller 38 after supplying the first drive current to the drive unit 101 to acceleratingly drive the intermediate feeding roller 38 (timing determination step) (S102).

After acceleratingly drive the intermediate feeding roller 38, in case it is determined that the timing for uniform drive comes (that is, the timing to acceleratingly drive the intermediate feeding roller 38 comes to an end) (S102, Yes), the drive control unit 102 supplies the first drive current to the drive unit 101 for a time period prolonged by a predetermined time period (for example, from 20 msec to 200 msec) (drive control step) (S103).

Then, after the predetermined time for prolongation period elapses, the drive control unit 102 starts to supply a second drive current that is smaller than the first drive current to the drive unit 101.

After acceleratingly drive the intermediate feeding roller 38, in case it is determined that the timing for uniform drive does not come (that is, the timing to acceleratingly drive the intermediate feeding roller 38 does not come to an end) (S102, No), the drive control unit 102 continues supplying the first drive current to the drive unit 101 (S104).

The drive control unit 102 supplies the first drive current to the drive unit 101 for a time period prolonged until at least the deflection of sheet raised at the time of correcting oblique-passing by the regist roller 37 is eliminated when the regist roller 37 is driven again (that is, the current is raised so that a time period of the state in which the posterior edge of a sheet is pinched by the feeding rollers is longer than a time period of the deflection of aligning value (the deflection A shown in FIG. 8)).

The time period until the deflection of sheet raised at the time of correcting oblique-passing by the above-described regist roller 37 is eliminated when the regist roller 37 is driven again is, when the feed distance from the point when a sheet fed by the intermediate feeding roller 38 is detected by an ante-regist sensor, not shown, right before the regist roller 37 to the point when the sheet feeding is stopped by the intermediate feeding roller 38 for aligning is L, a time period required to feed a sheet by the feed distance L by the regist roller 37 from the point when the aligning is completed.

In the drive control step (S103), it is desired that a time period for prolongation (a predetermined time period) by which a time period to supply the first drive current to the drive unit 101 is prolonged be changed depending on the size of a sheet being fed in the feeding direction (for example A3, A4, etc.). Specifically, in the drive control step (S103), it is desired that the predetermined time period be elongated in case the size of a sheet being fed in the feeding direction is large.

In the present embodiment, the respective steps of the processing in the sheet feeding method are realized by making the CPU 104 execute a sheet feeding program stored in the MEMORY 105.

Figure 3:
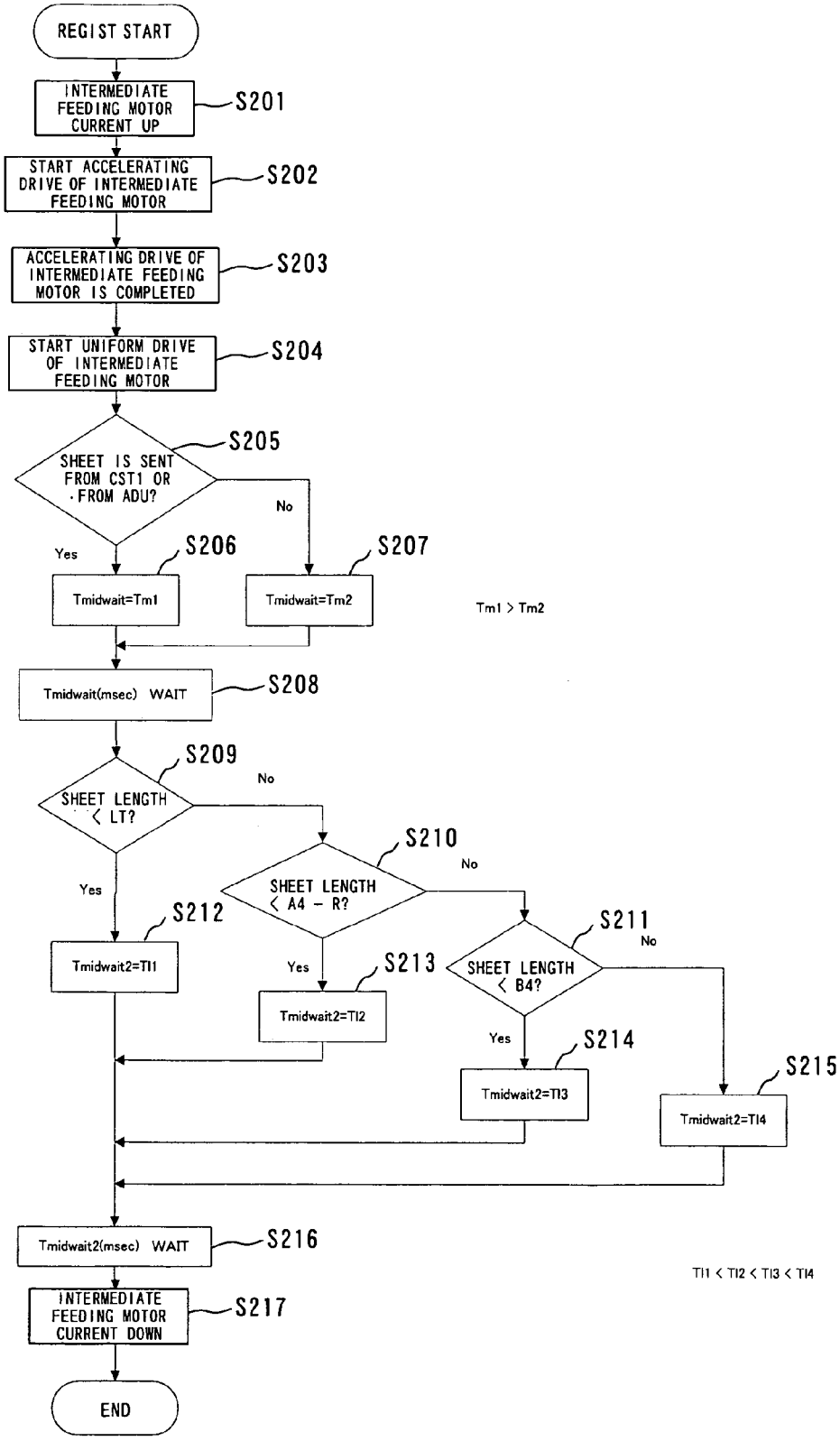
FIG. 3 shows a flowchart for explaining detailed processing of the sheet feeding method according to the present embodiment.

FIG. 3 shows a flow chart for explaining detailed processing of the sheet feeding method according to the present embodiment.

When acceleratingly driving the intermediate feeding roller 38, the drive control unit 102 supplies the first drive current A1 to the intermediate feeding motor (drive unit 101) to start accelerating drive of the intermediate feeding roller 38 (S201, S202).

In case the timing determination unit 103 determines that accelerating drive of the intermediate feeding roller 38 is completed and the timing for uniform drive comes (S203, S204), it is determined whether a sheet being fed is sent from a cassette CT1 of the upper stage (corresponding to the cassette 31) or from the ADU 5 (S205). Taking into consideration whether a sheet is sent from the ADU 5 or not is based on the concept that, in case a sheet is fed from the ADU 5, since the sheet feeding path is drastically curved, the sheet is wound around a feeding guide to increase the feeding load.

In case the sheet is sent from the cassette CT1 of the upper stage (corresponding to the cassette 31) or from the ADU 5 (S205, Yes), a time period for prolongation Tmidwait is set to be a time period Tm1 (S206). On the other hand, in case the sheet is not sent from the cassette CT1 of the upper stage (corresponding to the cassette 31) nor from the ADU 5 (S205, No), it is presumed that feed registance by rollers pinching the sheet is low, and the time period for prolongation Tmidwait is set to be a time period Tm2 that is shorter than the time period Tm1 (S207). Then, the drive control unit 102 prolongs the time period to supply the first drive current by the time period for prolongation Tmidwait (S208).

Next, it is determined whether the sheet size is LT or smaller, A4-R or smaller, B4 or smaller, or larger than those sizes (S209 to S211), and a time period for prolongation Tmidwait 2 is set to be any one of time periods T11 to T14 corresponding to the respective sheet sizes (S212 to S215).

Then, the drive control unit 102 prolongs the time period to supply the first drive current by the time period for prolongation Tmidwait 2 (S216), and changes the current to be supplied to the drive unit 101 to the second drive current A2 that is smaller than the first drive current A1 (S217).

Figure 4:
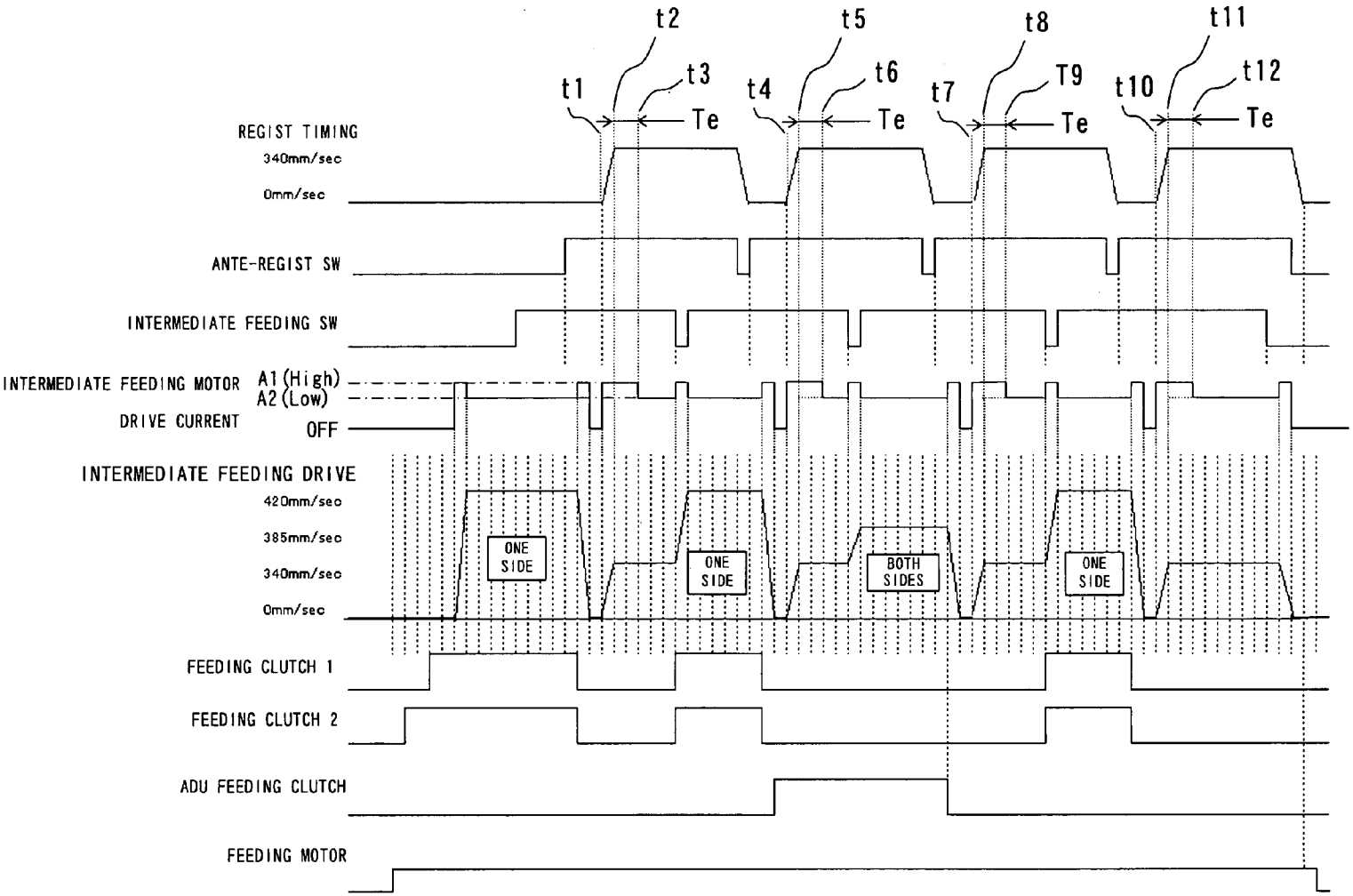
FIG. 4 shows a timing chart indicative of the sheet feeding by a regist roller, an intermediate feeding roller, etc., and the current supply to an intermediate feeding motor in the image forming apparatus according to the embodiment.
Figure 5:
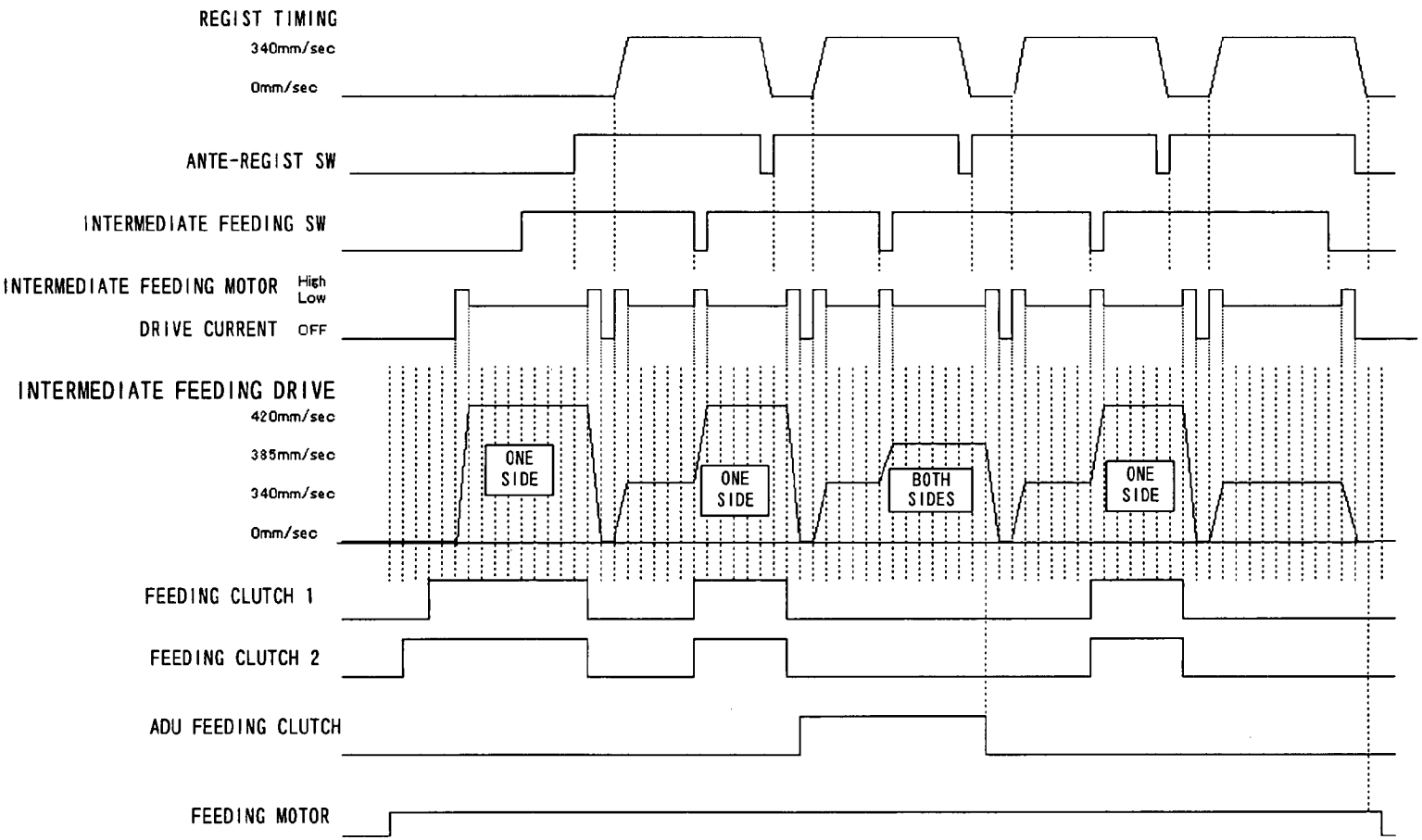
FIG. 5 shows a timing chart indicative of items similar to those shown in FIG. 4 in a conventional image forming apparatus.

FIG. 4 shows a timing chart indicative of the sheet feeding by the regist roller 37, intermediate feeding roller 38, etc., and the current supply to the intermediate feeding motor in the image forming apparatus according to the embodiment, while FIG. 5 shows a timing chart indicative of items similar to those shown in FIG. 4 in a conventional image forming apparatus.

A sheet that is fed from a cassette is carried forward to the regist roller 37 by the intermediate feeding roller 38 with the paper feeding speed of 420 mm/sec. Then, the sheet has its leading edge applied to a nip portion of the stopped regist roller 37 to be aligned.

The drive control unit 102 supplies the first drive current A1 to the intermediate feeding motor to start acceleratingly driving the regist roller 37 and the intermediate feeding roller 38 at the timing t1. Then, in case the timing determination unit 103 determines that the accelerating drive is completed and timing t2 for uniform drive comes, the drive control unit 102 further prolongs the time period to supply the first drive current A1 by Te from the timing t2, and supplies the first drive current A1 until timing t3.

Then, the drive control unit 102 changes the current to be supplied to the intermediate feeding motor to the second drive current A2, and drives the intermediate feeding roller 38 with a process speed of 340 mm/sec.

Then, a follow-on sheet that is made to stand by to form an image on one side thereof is carried forward to the regist roller 37 by the intermediate feeding roller 38 with a paper feeding speed of 420 mm/sec.

Then, after image forming processing for one sheet side is performed for two sheets, a sheet having an image formed on one side thereof is reversed to be carried forward, and is fed with an increased speed after switchback, and, after the speed is lowered right before the ADU 5, is carried forward to the regist roller 37 with an ADU speed of 385 mm/sec, to form an image on the other side thereof having formed thereon no image.

In FIG. 4 timing t2, t5, t8, and t11 correspond to the timing under which, after supplying the first drive current A1 to the drive unit 101 to acceleratingly drive the intermediate feeding roller 38, the current (second drive current) A2 smaller than the first drive current A1 is supplied to uniformly drive the intermediate feeding roller 38, and the time period Te corresponds to a predetermined time period for prolongation by which the time period to supply the first drive current A1 to the drive unit 101 is prolonged. It can be seen that the time period to supply the first drive current A1 is prolonged in the image forming apparatus according to the present embodiment as compared with the case shown in FIG. 5.

Figure 6:
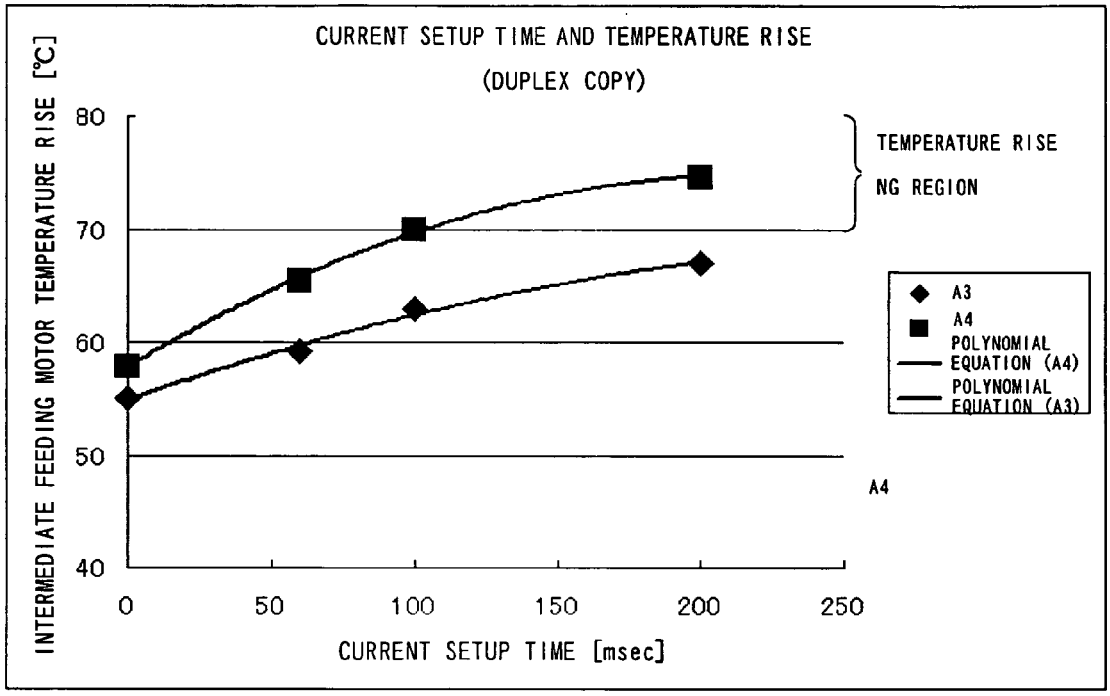
FIG. 6 shows a graphical representation indicative of the relation between the current setup time and temperature rise when duplex printing is performed for sheets.

FIG. 6 shows a graphical representation indicative of the relation between the current setup time and temperature rise when duplex printing is performed for sheets.

As has been described above, in the embodiment, so as to solve the problem of step-out of the intermediate feeding motor due to overload to the intermediate feeding roller 38, a time period to supply the drive current for accelerating drive is prolonged by Te. On the other hand, prolonging a time period to supply the drive current for accelerating drive leads to temperature rise of the intermediate feeding motor, and may be a problem on safety standard.

Accordingly, in the present embodiment, the time period to supply the drive current for accelerating drive is prolonged within the range in which there is no problem on safety standard (within the range in which the temperature of the intermediate feeding motor does not go beyond 70° C.). As can be seen from FIG. 6, as for a sheet of A3 size that is largely influenced by the feeding load, even though the time period to supply the first drive current A1 by 20 msec to 200 msec, temperature rise of the intermediate feeding motor does not become a problem.

As for the feeding load in sheet feeding, the load by paper feeding rollers and separation rollers is larger than the load by feeding rollers of the ADU 5. Accordingly, the present invention is not restricted to the above-described embodiment, and varying the current value between the case in which the posterior edge of a sheet is pinched by paper feeding rollers and separation rollers and the case in which the posterior edge of a sheet is pinched by feeding rollers of the ADU 5 is also effective.

Accordingly, in the present embodiment, so as to stabilize the sheet feeding by the regist roller and the feeding roller (intermediate feeding roller) arranged at the upstream of the regist roller, the current value to drive the motor of the intermediate feeding roller is raised for a predetermined time period only at the timing of sheet feeding when the load is large.

In the present embodiment, the case in which a copy paper is used as a sheet is employed. On the other hand, the present invention is not restricted to this, and an OHP film etc., may be used.

In the above-described embodiment, the function for implementing the present invention is stored inside an image forming apparatus in advance. On the other hand, the present invention is not restricted to this, that is, similar function may be downloaded to an image forming apparatus from a network, or a recording medium having stored therein similar function may be installed to an image forming apparatus. The recording medium may be of any figuration such as a CD-ROM so long as the recording medium can store programs and can be read out by an image forming apparatus. Furthermore, function obtained by previously performed installing and downloading may be realized cooperatively with the OS (operating system) in an image forming apparatus.

As in the above, according to the present embodiment, in the configuration in which a clutch is used to drive feeding rollers arranged at the upstream of the intermediate feeding roller, the occurrence of step-out of the intermediate feeding motor can be suppressed without enlarging the size of the intermediate feeding motor needlessly as well as without preventing the miniaturization of the entire device. Accordingly, an image forming apparatus that can stabilize the sheet feeding and has no problem in temperature rise of a motor can be realized. Furthermore, stability in sheet feeding and productivity at the time of forming an image on one side and at the time of forming images on both sides can be maintained.

While the present invention has been described in accordance with certain preferred embodiments in detail, it should be understood by those ordinarily skilled in the art that the invention is not limited to the embodiments, but various modifications, alternative constructions or equivalents can be implemented without departing from the scope and spirit of the present invention.

According to the present invention, it becomes possible to provide an image forming apparatus, a sheet feeding method, and a sheet feeding program that can suppress the occurrence of failure in feeding sheets without preventing reduction of cost and miniaturization of the device.

This application claims priority from Japanese Patent Application 2005-066886. filed Mar. 10, 2005, which is incorporated herein by reference in its entirety.

What is claimed is:

1. An image forming apparatus, comprising:

a drive unit that drives rollers for feeding sheets to be fed;

a drive control unit that supplies a first drive current to the drive unit so as to acceleratingly drive the rollers and supplies a second drive current that is smaller than the first drive current so as to uniformly drive the rollers; and a timing determination unit that determines a timing of supplying the second drive current to uniformly drive the rollers after supplying the first drive current to the drive unit to acceleratingly drive the rollers, wherein the drive control unit supplies the first drive current to the drive unit for a time period prolonged by a predetermined time period when the timing determination unit determines that a period for acceleratingly driving the rollers comes to an end.

2. An image forming apparatus, comprising:

a drive unit that drives an intermediate feeding roller for feeding sheets to a regist roller for skew correction of sheets being fed;

a drive control unit that supplies a first drive current to the drive unit so as to acceleratingly drive the intermediate feeding roller and supplies a second drive current that is smaller than the first drive current so as to uniformly drive the intermediate feeding roller; and a timing determination unit that determines a timing of supplying the second drive current to uniformly drive the intermediate feeding roller after supplying the first drive current to the drive unit to acceleratingly drive the intermediate feeding roller, wherein the drive control unit supplies the first drive current to the drive unit for a time period prolonged by a predetermined time period when the timing determination unit determines that a period for acceleratingly driving the rollers comes to an end.

3. The image forming apparatus according to claim 2, wherein the drive control unit supplies the first drive current to the drive unit for a time period prolonged until at least the deflection of sheet raised at the time of skew correction by the regist roller is eliminated when the regist roller is driven again.

4. The image forming apparatus according to claim 2, wherein the drive control unit changes the predetermined time period depending on the size of a sheet being fed in the feeding direction.

5. The image forming apparatus according to claim 2, wherein the drive control unit determines that the predetermined time period is greater when a sheet being fed in the feeding direction has a larger size.

6. A sheet feeding method, comprising:

a drive control step that supplies a first drive current to a drive unit that drives an intermediate feeding roller for feeding sheets to a regist roller for skew correction of sheets being fed so as to acceleratingly drive the intermediate feeding roller and supplies a second drive current that is smaller than the first drive current so as to uniformly drive the intermediate feeding roller; and a timing determination step that determines a timing of supplying the second drive current to uniformly drive the intermediate feeding roller after supplying the first drive current to the drive unit to acceleratingly drive the intermediate feeding roller, wherein the drive control step supplies the first drive current to the drive unit for a time period prolonged by a predetermined time period when the timing determination step determines that a period for acceleratingly driving the rollers comes to an end.

7. The sheet feeding method according to claim 6, wherein the drive control step supplies the first drive current to the drive unit for a time period prolonged until at least the deflection of sheet raised at the time of skew correction by the regist roller is eliminated when the regist roller is driven again.

8. The sheet feeding method according to claim 6, wherein the drive control step changes the predetermined time period depending on the size of a sheet being fed in the feeding direction.

9. The sheet feeding method according to claim 6, wherein the drive control step determines that the predetermined time period is greater when a sheet being fed in the feeding direction has a larger size.

10. A sheet feeding method, comprising:

determining a timing of supplying a second drive current to a drive unit to uniformly drive an intermediate feeding roller after supplying a first drive current to the drive unit for feeding sheets to a regist roller for skew correction of sheets being fed so as to acceleratingly drive the intermediate feeding roller; and supplying the first drive current to the drive unit for a time period prolonged by a predetermined time period when upon determining that a period for acceleratingly driving the rollers comes to an end.

11. The sheet feeding method according to claim 10, further comprising:

supplying the first drive current to the drive unit for a time period prolonged until at least the deflection of sheet raised at the time of skew correction by the regist roller is eliminated when the regist roller is driven again.

12. The sheet feeding method according to claim 10, further comprising:

changing the predetermined time period depending on the size of a sheet being fed in the feeding direction.

13. The sheet feeding method according to claim 10, further comprising:

determining that the predetermined time period is greater when sheet being fed in the feeding direction has a larger size.

* * * * *